United States Patent [19]

Laakso

[11] Patent Number: 4,746,404

[45] Date of Patent: May 24, 1988

[54] CHIP PRESTEAMING AND AIR WASHING

[76] Inventor: Oliver A. Laakso, Haralyn (West), #2 Middle Road, Smiths Parish, Bermuda, 3-18

[21] Appl. No.: 908,335

[22] Filed: Sep. 17, 1986

Related U.S. Application Data

[62] Division of Ser. No. 605,915, May 1, 1984, Pat. No. 4,632,729.

[51] Int. Cl.[4] ..... D21C 1/02

[52] U.S. Cl. ..... 162/232; 34/168; 34/176

[58] Field of Search ..... 162/17, 18, 19, 23, 162/25, 68, 52, 56, 60, 233, 242, 237, 246, 248, 250, 232; 34/33, 37, 168, 176

[56] References Cited

U.S. PATENT DOCUMENTS

| | | | |
|---|---|---|---|
| 850,384 | 4/1907 | Mallam | 162/246 |
| 3,201,307 | 4/1965 | Horstman | 162/246 |
| 3,270,437 | 9/1966 | Lara et al. | 34/168 |
| 3,525,665 | 8/1970 | Gessner | 162/19 |
| 3,681,192 | 8/1972 | Reinhall | 162/246 |

FOREIGN PATENT DOCUMENTS

| | | | |
|---|---|---|---|
| 708760 | 5/1965 | Canada | 162/60 |
| 347096 | 4/1931 | United Kingdom | 162/246 |

*Primary Examiner*—Peter Chin

*Attorney, Agent, or Firm*—Cushman, Darby & Cushman

[57] ABSTRACT

A method and apparatus are provided for effecting prestreaming and deaeration of wood chips, or like comminuted cellulosic fibrous material. Presteaming takes place in a vertical presteaming vessel, utilizing a plurality of uniformly radially spaced nozzles adjacent the bottom of the vessel, a plurality of generally uniformly radially spaced steam introduction pipes in a central portion of the vessel, and a pair of synchronized rotating valves for feeding steam to the introduction nozzles and pipes in a coordinated manner. After presteaming, the chips pass through a chips meter to a vertical chute in which they are entrained in liquid, and then pass to a horizontal deaerating vessel. In the deaerating vessel, deaerated liquid is passed in a path generally perpendicular to the path of the material flowing through the deaeration vessel. The deaerated material discharged from the deaeration vessel passes through a vertical chute to a conventional high pressure feeder, and then is subsequently passed to the top of a continuous digester.

8 Claims, 3 Drawing Sheets

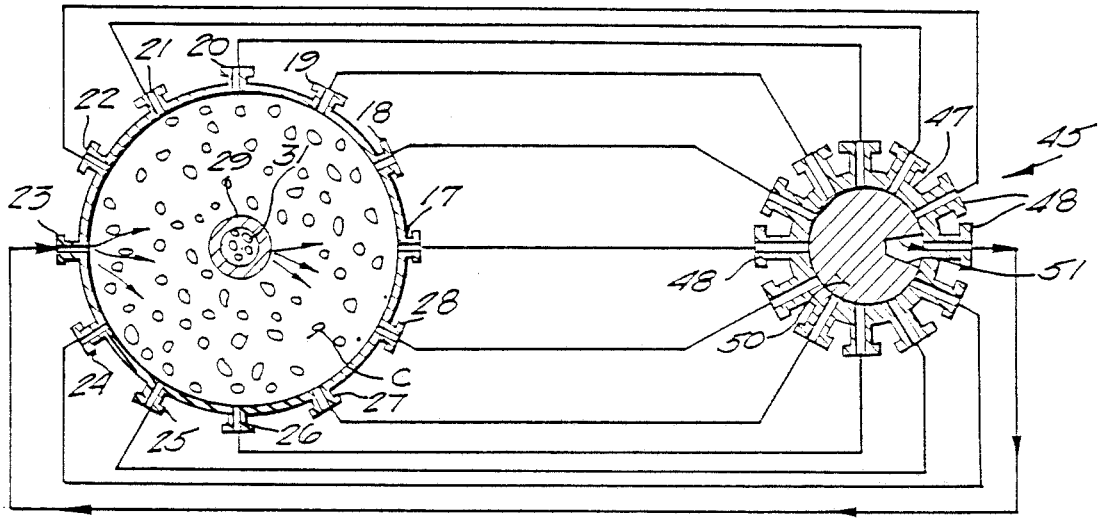
Fig. 2.
Fig. 3.
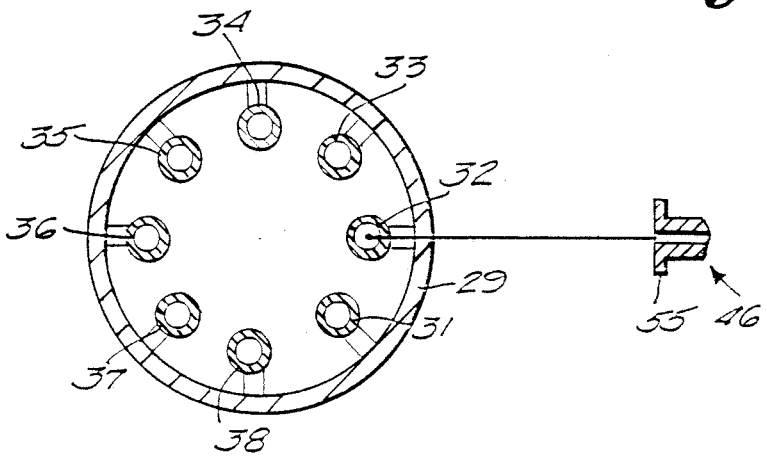

CHIP PRESTEAMING AND AIR WASHING

This is a division of application Ser. No. 605,915, filed May 1, 1984, now U.S. Pat. No. 4,632,729, granted Dec. 30, 1986.

BACKGROUND AND SUMMARY OF THE INVENTION

The invention relates to a method and system for heating and deaerating chips, or like comminuted cellulosic fibrous material, prior to digestion thereof.

The need for preheating and deaerating chips have been recognized substantially from the time that the first continuous digesters were constructed. In early designs of hydraulic digester feed systems, a horizontal presteaming vessel with an internal screw for transporting the chips through the vessel was utilized. The inlet of the vessel was equipped with a rotary pocket plug valve which maintained a pressure seal at the inlet, and steam was added to the bottom of the vessel. The vessel was operated at a pressure of about 15–20 psi, providing a temperature of 250° F.+ in the vessel. Air, plus some steam, was stripped from the top of the vessel. Time for the chips to pass through the vessel was in the order of 3–5 minutes.

As digester systems increased in size, the horizontal screw-type steaming vessel reached its practical size limit. Presently, the majority of presteaming of the chips is now done in the chips bin preceding the chips meter and preceding the pressure feeder of the horizontal steaming vessel. A typical system for presteaming chips in the chips bin is shown in U.S. Pat. No. 4,124,440.

With most of the steaming presently being done in the chips bin, the horizontal steaming vessel of modern, large-sized plants, is now used to strip air from the incoming chips, and to maintain an overpressure on the low pressure side of the rotary high pressure feeder.

Unless the air is stripped from the chips before they enter the hydraulically filled digester, the chips will tend to float, and hang-ups of the chip column in the digester will occur. Steam introduced into the chips in the horizontal steaming vessel effects stripping of the air from the chips.

Also, it is necessary that flashing of liquor into steam does not occur in the high pressure feeder, since if it does occur water hammer results in the chip feeder's circulation lines, with many undesirable consequences. The steam introduced in the horizontal steaming vessel thus maintains an overpressure of about 15 lbs./sq.in., which is usually sufficient to prevent flashing in the high pressure feeder.

According to the present invention, heating and deaeration of chips in a paper pulp production process are accomplished in a manner that has a number of advantages over conventional prior art systems. According to the present invention, presteaming of the chips is done in a separate and distinct manner from the stripping of the air from the chips, and deaeration is thus accomplished more efficiently. The practice of the present invention also reduces consumption of low pressure steam, and reduces capital investment for 700+ ton/-day systems (which are what are commonly built today), including by eliminating the low pressure feeder which is today commonly employed between the chips bin and the horizontal vessel. Also, the temperature of the slurry of chips in liquor fed by the high pressure feeder to the digester is lower than in conventional systems, providing less possibility of flashing in the high pressure feeder, and the overpressure to prevent flashing is provided hydraulically.

According to one aspect of the present invention, comminuted cellulosic fibrous material is treated, prior to digestion, by heating the material by subjecting it to low pressure steam in a first stage; removing air from the heated material in a manner distinct from the heating, and without introducing additional heat, in a second stage remote from the first stage; and passing the heated, deaerated material to a digesting stage. The deaeration step is practiced by entraining the material in liquid immediately after heating, passing the material entrained in liquid in a predetermined first path; and circulating deaerated liquid in a second path generally transverse to the first path and into contact with the material flowing in the first path, to effect removal of air therefrom. Presteaming in the vertical steaming vessel, and particular flow of fluids in the practice of the method, also provide advantageous results.

According to another aspect of the present invention, a novel structure for feeding steam into a vertical presteaming vessel is provided, and a novel deaeration vessel is provided. The steaming vessel and deaeration vessel are interconnected by a first vertical chute having a chips meter (but no low pressure feeder) therein, and the deaeration vessel is connected by a second, hydraulically filled, chute to a conventional high pressure transfer device which in turn is connected in a conventional way to a continuous digester.

The vertical presteaming vessel comprises: a generally vertical vessel shell; means for introducing steam into the shell to effect steaming of material therein; and the means for introducing steam into the shell comprising: a plurality of uniformly radially spaced nozzles disposed around the periphery of the vertical vessel adjacent the bottom thereof; a centrally extending conduit disposed vertically in the vertical vessel, and including a plurality of pipes therein, each pipe having a steam introducing orifice formed therein at generally the same level as the vertical position of the nozzles, the pipes being generally uniformly radially spaced; and means for feeding steam to the nozzles and the pipes so that steam is introduced into a nozzle at the same time as steam is introduced into a pipe so that the steam flowing through a nozzle flows with generally the same horizontal vector as the steam flowing from a pipe. Means for feeding steam to the nozzles and pipes preferably comprises: a pair of synchronized rotating valve plugs each mounted in a valve housing having a plurality of circumferentially radially spaced discharge ports, and having a steam introduction port; and means for effecting synchronized rotation of the valve plugs in the valve housings, each discharge port from one valve housing operatively connected up to a nozzle, and each discharge port from the other valve housing operatively connected to a steam introduction pipe.

The deaeration means preferably comprises a generally horizontally extending vessel, having a generally horizontal axis, and a rotatable screw extending along the axis. Steamed chips entrained in liquid are fed into the horizontal vessel at one end thereof, and deaerated chips are removed from the vessel at the other end thereof. Liquid circulation loops are provided at both the inlet to and outlet from the horizontal vessel. At a central portion of the vessel, deaerated liquid is continuously circulated into contact with material passing in the vessel, screens generally parallel to the axis of the vessel being part of the system for providing for the flow of deaerated liquid. A closed recirculatory loop of such liquid is provided, and a liquid and air separator is provided in that loop to effect deaeration of the liquid flowing therein.

It is the primary object of the present invention to provide a method and apparatus for effectively treating comminuted cellulosic fibrous material, and the like, to effect heating and/or deaeration thereof. This and other objects of the present invention will become clear from an inspection of the detailed description of the invention, and from the appended claims.

BRIEF DESCRIPTION OF THE DRAWINGS

FIG. 2 is a detail cross-sectional view taken along lines 2—2 of FIG. 1;

FIG. 3 is an enlarged cross-sectional view of the steam introduction conduit and associated pipes illustrated in FIGS. 1 and 2.

DETAILED DESCRIPTION OF THE DRAWINGS

Figure 1:
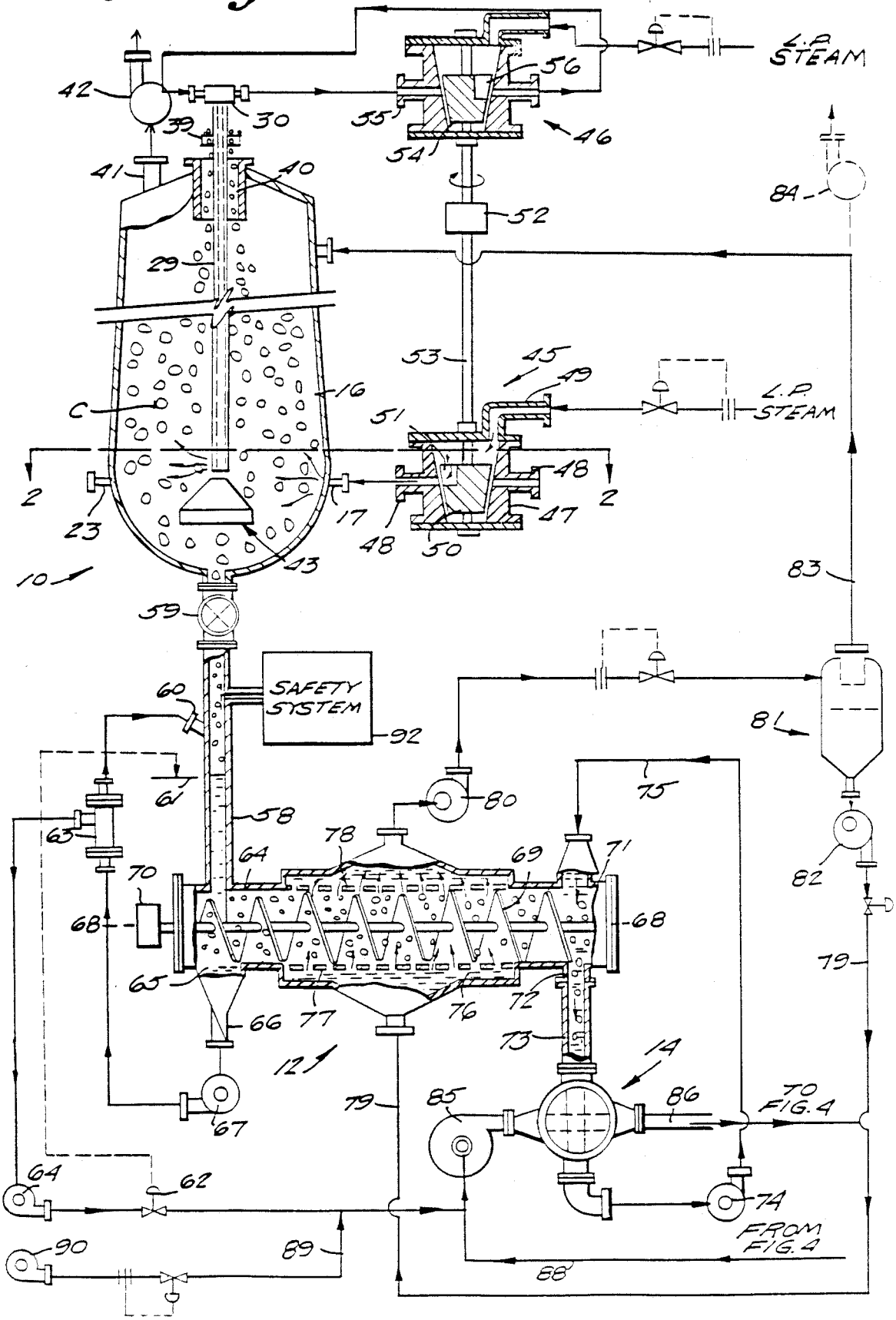
FIG. 1 is a side schematic cross-sectional view, with some components shown in elevation, of an exemplary system for practicing an exemplary method according to the present invention.

Exemplary apparatus for practicing the method according to the present invention is illustrated in FIG. 1. The basic components of the invention comprise a means for steaming wood chips (or like comminuted cellulosic fibrous material), such as a vertical presteaming vessel 10; means for effecting deaeration of the chips, such as the horizontal deaeration vessel 12; and means for passing the heated, deaerated chips to a continuous digester 13 (see FIG. 4), such as the conventional high pressure transfer device 14.

The vertical steaming vessel 10 includes a vessel shell 16, and means for feeding low pressure steam to the chips C within the shell 16. Such means preferably take the form of a plurality of generally uniformly radially spaced nozzles 17 through 28 (see FIG. 2) adjacent the bottom portion of the vessel 10, and a generally centrally extending conduit 29, disposed vertically by a mounting mechanism 30 within the vessel 10. Disposed within the conduit 29 are a plurality of uniformly radially spaced steam introduction pipes 31–38, each having an orifice (such as an opening in a side wall thereof corresponding to a like opening in conduit 29) disposed at generally the same vertical level as the nozzles 17 through 28.

A chips conveyance means, shown generally by reference numeral 39 in FIG. 1 (which may comprise a conveyor belt, blower, or the like) feeds chips through central sleeve 40 in the top of the shell 16, and gases at the top of the vessel 10 are removed through conduit 41 by exhaust fan 42 or the like. At the bottom of the vessel 10, a conventional "VibraBin" vibrating discharge mechanism is provided to fluidize the chips and facilitate the flow thereof to the vessel 12. The vibrating discharge mechanism is shown only schematically in FIG. 1 and illustrated by reference numeral 43.

Means are provided for feeding steam to the nozzles 17–28 and the pipes 31–38 in order to effect proper steaming of the chips C within the bin. Such feeding means preferably comprise means for feeding the steam so that steam introduced by one of the nozzles 17–28 flows in generally the same radial line (i.e. with generally the same horizontal vector) within the vessel 10 as steam simultaneously being introduced by a pipe 31–38. In this regard see the steam introduction direction arrows extending from nozzle 17 in FIG. 1, which are in a generally radial line with the steam introduction arrows emanating from the central conduit 29 in FIG. 1. Also see the steam introduction arrows emanating from nozzle 23 in FIG. 2, which are generally radially aligned with the steam introduction arrows emanating from pipe 31 in FIG. 2. By introducing steam in such a manner, uniform treatment ensues since steam from any nozzle or pipe need only penetrate a distance of one-half the radius of the vessel, and since the steam introduction is sequentially moved around the circumference of the vessel 10 from nozzle-to-nozzle and pipe-to-pipe, uniformity is further ensured.

Preferably the means for feeding steam to the nozzles 17 through 28 and pipes 31 through 38 comprises a pair of synchronized rotating valve mechanisms 45, 46.

Valve 45, as shown most clearly in FIGS. 1 and 2, comprises a housing 47 having a plurality of outlet ports 48 uniformly radially spaced along the periphery thereof, has an inlet port 49, and a plug 50 mounted for rotation within the housing 47. The plug 50 includes a cut-out 51 therein for providing communication between the inlet 49 and one (or more) of the outlet conduits 48. Each of the conduits 48 is connected to one of the nozzles 17 through 28, as most clearly seen in FIG. 2. As plug 50 rotates it circumferentially sequentially supplies steam to the nozzles 28 in clockwise order.

The plug 50 is driven by a drive gear and motor assembly 52, which preferably drives the plug 50 at about 1–4 rpm. A shaft 53 interconnects the drive 52, plug 50, and plug 54 of the valve means 46.

The valve means 46 is substantially identical to the valve means 45, except for the number of outlet conduits 55 and the arcuate extent of the cut-out 56 in the plug 54. In the embodiment illustrated in FIGS. 1 through 3, eight pipes 31–38 are provided, and correspondingly eight outlet ports 55, while twelve nozzles 17–28 are provided, and corresponding twelve outlet ports 48. Each of the outlets 55 is connected to one of the pipes 31–38.

The cut-outs 51, 56 in the plugs 50, 54 are synchronized so that the centers thereof are substantially 180° apart, so that steam is supplied to the chips C in the manner indicated by the arrows in FIGS. 1 and 2.

Operatively interconnecting the vessels 10 and 12 is a generally vertically disposed first chute 58. A conventional chips meter 59 is provided for metering the chips from the vessel 10 into the chute 58, but in the apparatus according to the present invention there is no necessity for a conventional low pressure feeder. In the chute 58, the chips are entrained in liquid which is supplied through inlet 60, and a liquid level 61 is established by throttling—by way of throttling valve 62—the discharge from in-line liquor drainer 63 through pump 64.

The chute 58 is connected to the vessel 12 at a first end 64 thereof, and preferably a screen 65 is provided in the vessel 12 vertically below the chute 58, with a conduit 66 extending from the screen 65 operatively connected to a pump 67. The chute 58, pump 67, drainer 63, and inlet 60 provide a generally vertically disposed recirculatory loop for providing liquid for entraining chips.

The vessel 12 is generally horizontally disposed, having a generally horizontal axis 68–68. Preferably a rotatable screw 69, rotatable by motor 70, is disposed in the vessel 12, and is coaxial with the axis 68.

At the second end 71 of the vessel 12, a discharge for the chips entrained in liquid is provided. This discharge comprises an outlet conduit 72 extending downwardly from the bottom of the vessel 12, and connected to a second generally vertically chute 73, the chute 73 in turn being connected at the bottom thereof to the high pressure feeder 14. The chute 73 comprises part of the conventional low pressure circulatory loop of the high pressure feeder 14, including low pressure pump 74, and return conduit 75. The chute 73 is hydraulically filled at all times, and the entire column of liquid from the liquid level 61 provides a hydraulic head sufficient to overpressure the transfer device 14 (e.g., provide 15 lbs./sq.in. overpressure to prevent flashing).

In the vessel 12, the chips are deaerated while being conveyed, and mechanically agitated, by the screw 69. This is accomplished hydraulically, utilizing the header 76, and bottom and top screens 77, 78, the screens 77 and 78 being generally parallel to the axis 68. Preferably each of the screens 77, 78 is arcuate and covers approximately one-quarter the circumference of the path of chips flowing generally horizontally through the vessel 12. The components are designed so that the chips typically have a residence time of about 60 seconds in the vessel 12.

Deaerated liquid is introduced by conduit 79 into the bottom of the header 76, passes upwardly through the screens 77, 78 generally transverse to the axis 68 (as indicated by the arrows in FIG. 1), and passes out the top of the vessel 12 under the influence of pump 80. The liquid passing through the chips removes air from the chips and replaces it with liquid. The fluid being pumped by pump 80 thus includes both air and liquid, and it is passed to a conventional air and liquor separator, such as a conventional centrifugal separator 81. In the separator 81 the liquid is deaerated, and the deaerated liquid is pumped by pump 82 into the conduit 79. The gas is separated from the liquid by the separator 81 and vented upwardly into conduit 83, which preferably is vented into the top of the vessel 10, or—as shown by dotted line in FIG. 1—is vented by pump 84 or the like to atmosphere, a gas cleaning device, or the like.

Typically in the practice of the present invention, the temperature of the chips and liquor in the chute 73 is between about 205° F.–215° F. (as compared to about 230° F.–235° F. conventionally). This, combined with the approximately 15 lbs. hydraulic overpressure, prevents flashing in the device 14.

Figure 4:
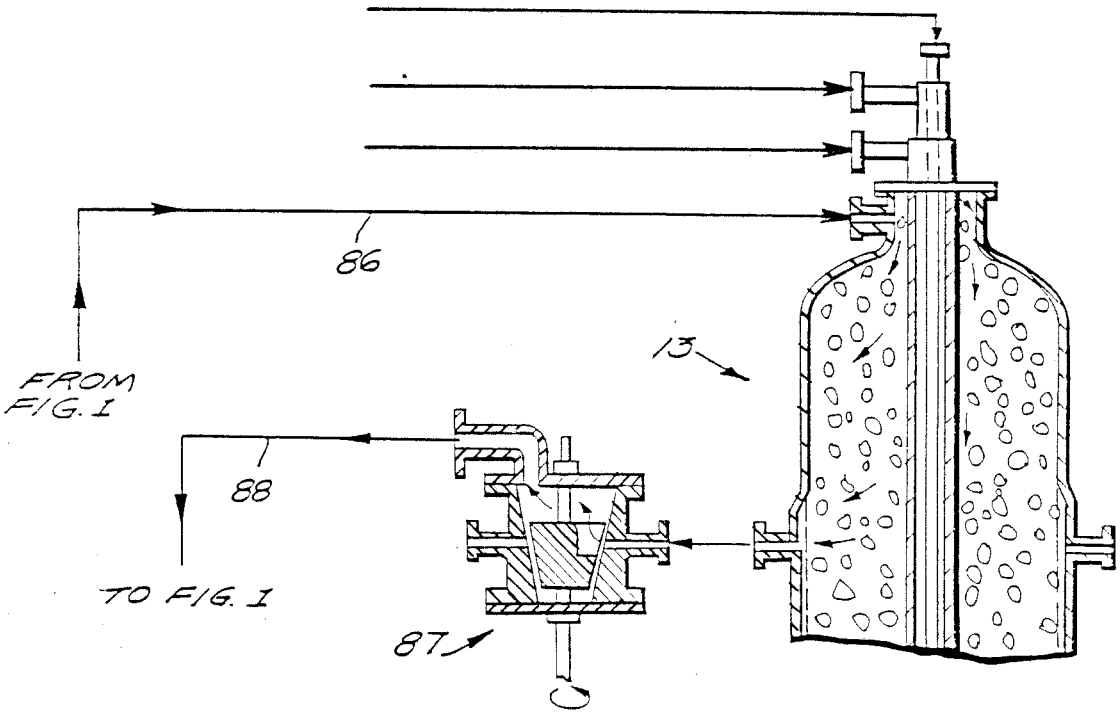
FIG. 4 is a schematic side cross-sectional view of a top portion of a continuous digester which may be connected to the apparatus of FIG. 1.

The high pressure pump 85 associated with the transfer device 15 pumps the chips into high pressure line 86, which goes to the top of the continuous digester 13. Any suitable continuous digester 13 may be utilized. In FIG. 4, the digester 13 illustrated is a digester shown in copending application Ser. No. 583,856, filed Feb. 27, 1984. Such a digester 13 has a transfer valve 87 associated therewith, and a liquid return line 88 to the inlet side of the pump 85. Fresh cooking liquor is supplied to the inlet side of the pump 85 through line 89 by pump 90.

For safety purposes, a safety system 92 [FIG. 1] may be provided to protect the chips meter 59 and the vessel 10 should there—for some reason—be a backup of liquid through the vessel 12 and into the chute 58. The system 92 provides for overflow of the liquid before reaching the chips meter 59.

In the practice of the method according to the present invention, chips are fed via conveyor 39 into the top of the presteaming vessel 10, and form a column therein. Low pressure steam is continuously introduced into the vessel 10 in a circumferentially changing sequential manner by the transfer valves 45, 46 supplying steam through nozzles 17 through 28 and pipes 31 through 38. The steam is uniformly distributed through the vessel 10, and provides even and uniform heating of the chips.

After steaming, the chips are fluidized by the vibrator 43, and metered by meter 59 into the chute 58, wherein they are entrained in liquid. A continuous circulatory loop of the entraining liquid is provided by pump 67, drainer 63 and inlet 60, etc. The chips are conveyed by rotatable screw 69 generally in a horizontal direction along the axis 68—68. While in the vessel 12, the chips are subjected to a cross-flow of deaerated liquid which is introduced through conduit 79 and screens 77, and withdrawn through screens 78 by pump 80. The withdrawn liquid is deaerated in centrifugal separator 81, and passed back to the conduit 79 in a recirculatory loop.

The heated, deaerated chips—at a temperature between about 205° F.–215° F.—are discharged from the vessel 12 through chute 73 in the low pressure loop of the feeder 14, and are transferred under the influence of the high pressure pump 85 to the top of the digester 13. In digester 13, conventional impregnation, cooking, and washing steps, etc., are practiced, to ultimately produce paper pulp.

Thus, it will be seen that in a simple manner, with less capital investment and with greater efficiency than in the prior art, a method and apparatus have been provided for the heating and deaeration of chips prior to digestion thereof.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and devices.

What is claimed is:

1. Apparatus for treating comminuted material, comprising:

a vertical steaming vessel;

means for introducing low pressure steam into said vertical steaming vessel;

a first vertically extending chute operatively connected to said vertical steaming vessel at the top end of said chute;

a generally horizontally extending vessel having a generally horizontal axis, and having material conveyance means disposed therein;

said first vertical chute operatively connected at the bottom thereof to a first end of said generally horizontal vessel;

means for circulating liquid through said generally horizontally extending vessel in a direction generally perpendicular to the axis of said generally horizontal vessel, said means including screen means disposed in said vessel and extending generally parallel to the axis thereof;

a second chute comprising a generally vertically extending discharge chute extending generally downwardly from a second end of said horizontal vessel; and a high pressure transfer device operatively connected to said second chute.

2. Apparatus as recited in claim 1 wherein said means for circulating liquid generally perpendicular to the axis of said generally horizontal vessel comprises a recirculatory loop, and an air/liquid separating means disposed in said loop for removing air from liquid circulating in said loop.

3. Apparatus as recited in claim 1 further comprising a liquid circulatory loop including: said first chute; screen means formed at the bottom of said generally horizontal vessel below the connection of said first chute thereto; and means for maintaining a level of liquid in said first chute.

4. Apparatus as recited in claim 1 further comprising safety release means operatively connected to said first chute below said vertical steaming vessel and above the level of liquid maintained in said chute by said liquid level maintaining means.

5. Apparatus as recited in claim 1 wherein said material conveyance means in said generally horizontal vessel comprising a rotating screw.

6. Apparatus as recited in claim 3 further comprising material flow control means interconnecting the bottom of said generally vertical steaming vessel and the top of said first chute, said interconnecting means consisting of a chips meter.

7. A material steaming vessel comprising:

a generally vertical vessel shell;

means for introducing steam into said shell to effect steaming of material therein; and said means for introducing steam into said shell comprising:

a plurality of uniformly radially spaced nozzles disposed around the periphery of said vertical vessel adjacent the bottom thereof;

a centrally extending conduit disposed vertically in said vertical vessel, and including a plurality of pipes therein, each pipe having a steam introducing orifice formed therein at generally the same level as the vertical position of the nozzles, said pipes being generally uniformly radially spaced; and means for feeding steam to said nozzles and said pipes so that steam is introduced into a nozzle at the same time as steam is introduced into a pipe so that the steam flowing through the nozzles flows with generally the same horizontal vector as the steam flowing from said pipe;

said feeding means comprising a pair of synchronized rotating valve plugs each mounted in a valve housing having a plurality of circumferentially radially spaced discharge ports, and having a steam introduction port; and means for effecting synchronized rotation of said valve plugs in said valve housings, each discharge port from one valve housing operatively connected up to a nozzle, and each discharge port from the other valve housing operatively connected to a steam introduction pipe.

8. Apparatus for treating comminuted material, comprising:

a vertical steaming vessel;

means for introducing low pressure steam into said vertical steaming vessel;

a first vertically extending chute operatively connected to said vertical steaming vessel at the top end of said chute;

a generally horizontally extending vessel having a generally horizontal axis, and having material conveyance means disposed therein;

said first vertical chute operatively connected at the bottom thereof to a first end of said generally horizontal vessel;

means for circulating liquid through said generally horizontally extending vessel in a direction generally perpendicular to the axis of said generally horizontal vessel, said means including screen means disposed in said vessel and extending generally parallel to the axis thereof;

a second chute comprising a generally vertically extending discharge chute extending generally downwardly from a second end of said horizontal vessel; and a high pressure transfer device operatively connected to said chute;

said means for introducing low pressure steam into said vertical steaming vessel comprising:

a plurality of uniformly radially spaced nozzles disposed around the periphery of said vertical vessel adjacent the bottom thereof;

a centrally extending conduit disposed vertically in said vertical vessel, and including a plurality of pipes therein, each pipe having a steam introducing orifice formed therein at generally the same level as the vertical position of the nozzles, said pipes being generally uniformly radially spaced; and means for feeding steam to said nozzles and said pipes so that steam is introduced into a nozzle at the same time as steam is introduced into a pipe so that the steam flowing through the nozzle flows with generally the same horizontal vector as the steam flowing from said pipe;

said feeding means comprising a pair of synchronized rotating valve plugs each mounted in a valve housing having a plurality of circumferentially radially spaced discharge ports, and having a steam introducing port; means for effecting synchronized rotation of said valve plugs in said valve housings, each discharge port from one valve housing being operatively connected to a nozzle, and each discharge port from the other valve housing being operatively connected to a steam introduction pipe.

* * * * *